US005715623A

United States Patent [19]

Mackey, III

[11] Patent Number: 5,715,623

[45] Date of Patent: Feb. 10, 1998

[54] FIREARM ALARM HAVING REMOTE INDICATOR

[76] Inventor: Earl H. Mackey, III, P. O. Box 5351, Abilene, Tex. 79608

[21] Appl. No.: 699,121

[22] Filed: Aug. 16, 1996

[51] Int. Cl.[6] ..... F41A 9/53

[52] U.S. Cl. ..... 42/1.01; 42/70.01

[58] Field of Search ..... 42/1.01, 70.01, 42/66; 340/506, 539, 825.69

[56] References Cited

U.S. PATENT DOCUMENTS

| | | | |
|---|---|---|---|
| 665,405 | 1/1901 | Baggett | 42/84 |
| 2,600,363 | 6/1952 | Morris | 177/311 |
| 3,044,204 | 7/1962 | Zimmerman | 42/84 |
| 3,728,675 | 4/1973 | Horn et al. | 25/10 |
| 4,155,079 | 5/1979 | Chiu et al. | 13/14 |
| 4,319,230 | 3/1982 | Fowler et al. | 340/539 |
| 4,375,135 | 3/1983 | Wigger | 42/1 A |
| 4,476,644 | 10/1984 | Laing . | |
| 4,535,324 | 8/1985 | Levental | 340/574 |
| 4,739,569 | 4/1988 | Battle . | |
| 4,829,692 | 5/1989 | Guild | 17/2 |
| 4,864,277 | 9/1989 | Goodman | 340/539 |
| 4,948,371 | 8/1990 | Hall | 434/21 |
| 5,001,461 | 3/1991 | Vroom et al. | 13/14 |
| 5,016,378 | 5/1991 | Sain | 17/52 |
| 5,183,951 | 2/1993 | Bilodeau | 42/1.01 |
| 5,260,689 | 11/1993 | Meyers et al. | 13/14 |
| 5,270,686 | 12/1993 | Martinez . | |
| 5,437,117 | 8/1995 | Mackey, III | 42/1.01 |
| 5,479,149 | 12/1995 | Pike | 340/539 |
| 5,487,234 | 1/1996 | Dragon | 42/70.07 |

*Primary Examiner*—Charles T. Jordan
*Assistant Examiner*—Meena Chelliah
*Attorney, Agent, or Firm*—Sidley & Austin

[57] ABSTRACT

An apparatus for producing an audible alarm signal upon the handling of a firearm is provided comprising a transmitter unit adapted for connection to the firearm and producing a non-audible signal when the firearm is handled and a discrete receiver unit which may be positioned at a location remote from the transmitter unit for receiving the non-audible signal and producing an audible alarm signal when the protected firearm is handled. The transmitter unit may be adapted to be received into the chamber of the firearm to be protected or it may be adapted for connection to the exterior of the firearm to be protected.

8 Claims, 4 Drawing Sheets

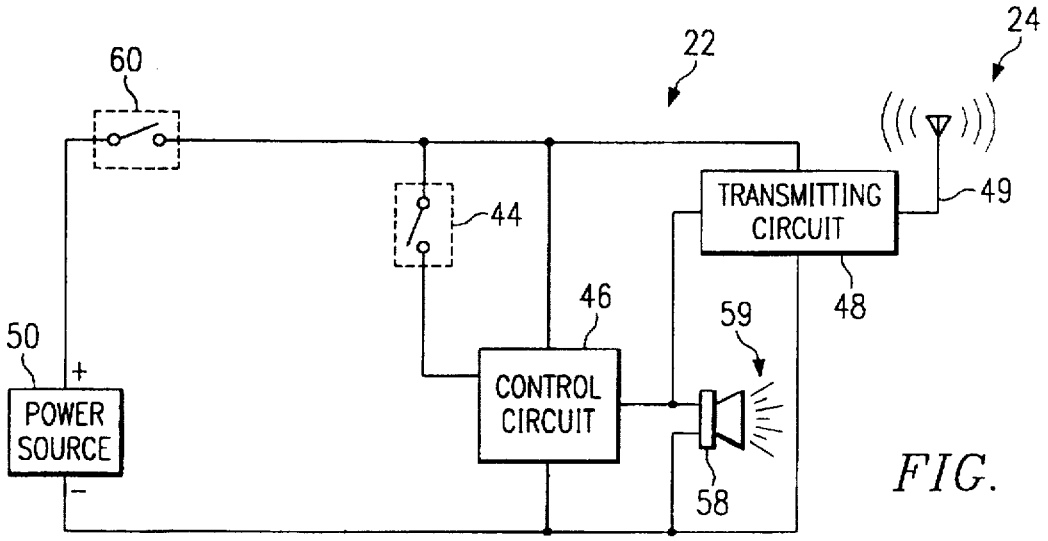
FIG. 1
FIG. 2
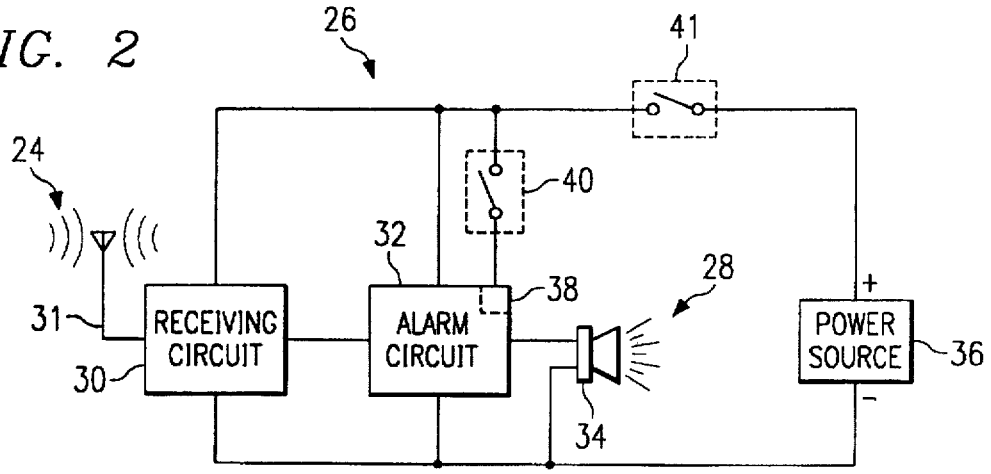
FIG. 3
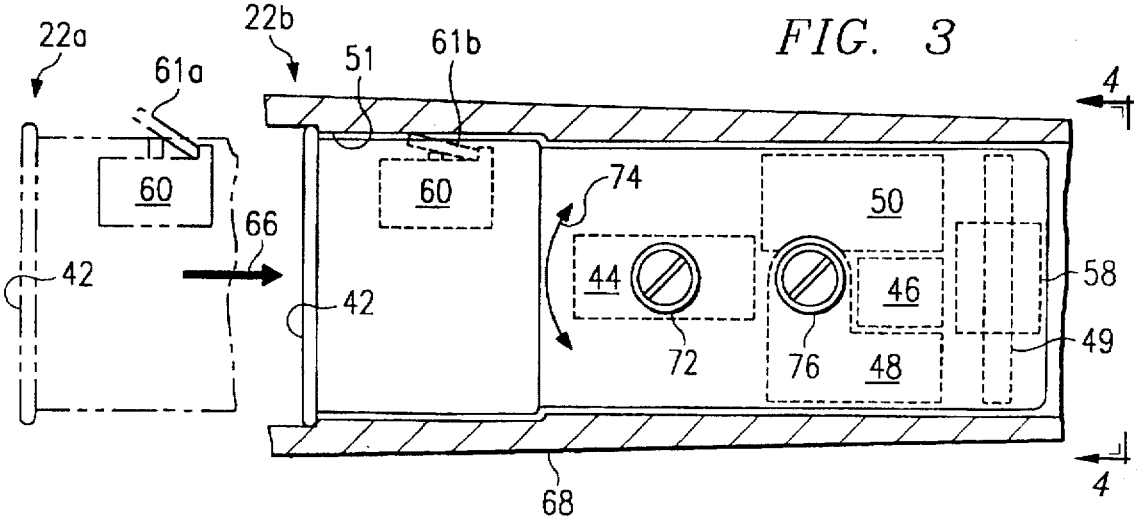

FIREARM ALARM HAVING REMOTE INDICATOR

TECHNICAL FIELD OF THE INVENTION

The present invention relates to alarm devices for signaling unwanted handling of a firearm. In one aspect, it relates to an alarm which, upon the handling of a firearm, produces an audible signal at a remote location.

BACKGROUND OF THE INVENTION

Numerous devices and apparatus have been developed to sound an alarm when a firearm is mishandled or handled by an unauthorized person. Of special interest is preventing the handling of firearms by young children. One example of such devices is U.S. Pat. No. 5,437,117 to Mackey, III, for an alarm device in the size and shape of ammunition to be inserted into the chamber of the firearm which produces an audible signal when the firearm is picked up or moved. The device disclosed in U.S. Pat. No. 5,437,117 uses a position-responsive switch to detect handling of the firearm and an audio speaker attached to the housing of the device to produce the audible alarm signal.

An alarm device which is adapted to fit into the chamber of a firearm will by necessity have certain limitations in the size of the audio speaker and power source which are used to produce the audible alarm signal. This results in limitations in the audio power output of the speaker. In addition, the audible signal will be attenuated as it travels out the barrel, muzzle or chamber of the firearm. These factors may limit the detection range of an audible alarm signal produced by such a safety device. A need therefore exists for a firearm safety device in the size and shape of ammunition to be inserted into the chamber of a firearm which produces an audible alarm signal whose power is not limited by factors relating to the size of the firearm chamber.

Regardless of the audio power output produced by a firearm safety device, it is often desirable that the alarm signal be produced at a location remote from the sensor device attached to the firearm. For example, a firearm may be stored in a basement, garage or upstairs closet, such that a warning signal might not be heard in the normal living area of a house. A need exists, therefore, for a firearm safety device that produces an audible alarm signal at a location remote from the firearm itself.

SUMMARY OF THE INVENTION

A firearm safety device having a transmitter unit adapted for connection to a firearm for producing a non-audible signal when the firearm is handled and a discrete receiver unit adapted to receive the non-audible signal from the transmitter unit and to produce an audible alarm signal when the firearm is handled. The discrete receiver unit comprises a receiving circuit for receiving non-audible signals from the transmitter unit and producing outputs to an alarm circuit, an alarm circuit connected to the receiving circuit for receiving outputs from the receiving circuit and powering a sound generator, a sound generator connected to the alarm circuit for providing an audible alarm signal when the firearm is handled, and a power source to supply electrical power to the receiving circuit and alarm circuit. In one embodiment, the alarm circuit of the receiver unit powers the sound generator to produce an audible alarm signal while the non-audible signal is received from the transmitter unit and does not power the sound generator when a non-audible signal is not received. In another embodiment, the alarm circuit further comprises a latch subcircuit for powering the sound generator to produce an audible alarm signal while a non-audible signal is received by the receiving circuit and, after the receiving circuit has received the non-audible signal, for continuing to power the sound generator even when the non-audible signal is not received by the receiving circuit until a reset signal is received by the latch subcircuit, and a reset subcircuit connected to the latch subcircuit for producing a reset signal. The reset subcircuit may produce a reset signal in response to a manual input by the user, or the reset subcircuit may produce a reset signal at a predetermined time after the receiving circuit stops receiving the non-audible signal, after having first received the non-audible signal from the transmitter unit.

The transmitter unit comprises a housing adapted for connection to a firearm, a position-responsive switch enclosed within the housing, the position-responsive switch having a first output when in a first position, and a second output when in a second position, a control circuit enclosed within the housing and connected to the position-responsive switch for powering a transmitting circuit, a transmitting circuit enclosed in the housing and connected to the control circuit for producing a non-audible signal when the firearm is moved from a first position to a second position, and a power source enclosed in the housing to supply electrical power to the position-responsive switch, control circuit and transmitting circuit. The transmitter unit may further comprise a power switch for energizing the transmitter unit for operation.

In one embodiment, the housing of the transmitter unit is adapted to be received into the chamber of a firearm. When the transmitter unit of this embodiment includes a power switch, this embodiment may further comprise a contact member extending from the housing whereby the contact member activates the power switch when the transmitter unit is inserted into a chamber of a firearm. In another embodiment, the housing of the transmitter unit is adapted to be attached to the exterior of a firearm.

In yet another embodiment of the current invention, the transmitting circuit of the transmitter unit is an FM radio transmitter, the receiving circuit of the receiver unit is an FM radio receiver, and the non-audible signal is an FM radio signal in the frequency range of about 88 MHZ to about 108 MHZ. In this embodiment, the transmitter unit may include a tuning screw for selecting the frequency of the non-audible signals generated by the transmitting circuit, and the receiver unit may include a tuning screw for selecting the frequency of the non-audible signal, which when received by the receiver unit, will cause the audible alarm signal to be produced.

In still another embodiment, the transmitting circuit of the transmitter unit is an ultrasonic acoustic transmitter, the receiving circuit of the receiver unit is an ultrasonic acoustic receiver and the non-audible signal is an ultrasonic acoustic signal in the range of about 20 to about 62 kHz.

In a further embodiment of the current invention, the transmitter unit further comprises a sound generator attached to the housing and connected to the control circuit for producing an audible alarm signal when the non-audible signal is produced.

Yet another embodiment of the current invention provides a firearm safety apparatus for simultaneous use with a plurality of firearms, said apparatus comprising: a plurality of discrete transmitter units, each transmitter unit connected to one firearm for producing a non-audible signal when the firearm is handled, all non-audible signals from the transmitter units having a common set of characteristics, and a discrete receiver unit for receiving the non-audible signals having the common set of characteristics from the transmitter units and for producing an audible alarm signal when any of the firearms is handled.

BRIEF DESCRIPTION OF THE DRAWINGS

FIG. 1 is a block diagram of a transmitter unit according to one aspect of the current invention;

FIG. 2 is a block diagram of a receiver unit according to another aspect of the current invention;

FIG. 3 is a side elevation view of a transmitter unit according to one embodiment of the current invention installed in the chamber of a firearm;

DETAILED DESCRIPTION

Figure 4:
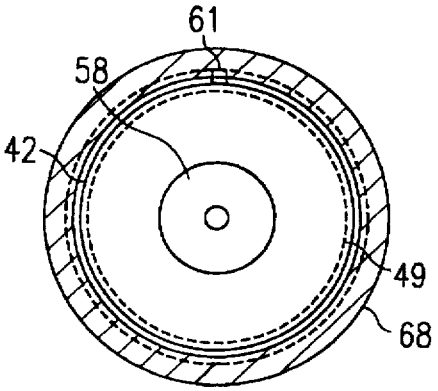
FIG. 4 is a front elevation view of the transmitter unit of FIG. 3 viewed along lines 4—4 of FIG. 3.

Referring to FIGS. 1 and 2, a firearm safety apparatus is provided comprising a transmitter unit 22 adapted for connection to a firearm (not shown) for producing a non-audible signal 24 when the firearm is handled and a discrete receiver unit 26 adapted to receive non-audible signal 24 produced by transmitter unit 22 and to produce an audible alarm signal 28 when the firearm is handled.

Receiver unit 26 need not be located directly adjacent to the firearm or transmitter unit 22, but instead my be positioned at any convenient location within range of the non-audible signal 24 produced by transmitter unit 22. This allows the positioning of receiver unit 26 at an advantageous location for connection to AC electrical power (if required) or to optimize the detection of audible alarm signal 28. For the purposes of this description, a "non-audible" signal is any signal which is not normally detectible by ordinary unaided human hearing. Non-audible signals include AM and FM radio signals, microwaves, infrared light, and ultrasonic sound (i.e., sound waves at frequencies beyond the range of ordinary human hearing). Similarly, for the purposes of this description, an "audible" signal is a signal which is generally perceptible to the ordinary unaided human ear.

Referring now to FIG. 2, receiver unit 26 further comprises a receiving circuit 30, an alarm circuit 32, a sound generator 34, and a power source 36. Receiving circuit 30 receives non-audible signals 24 from transmitter unit 22 and produces a first output when non-audible signal 24 is received from transmitter unit 22 and produces a second output when non-audible signal 24 is not received from transmitter unit 22. In some embodiments, an antenna 31 may be connected to receiving circuit 30 to improve the reception of non-audible signal 24. Alarm circuit 32 is connected to receiving circuit 30 for receiving the outputs from receiving circuit 30 and powering sound generator 34. Sound generator 34 is connected to alarm circuit 32 for producing an audible alarm signal 28 when the firearm is handled. Power source 36 is connected to receiving circuit 30, alarm circuit 32 and sound generator 34 to supply power necessary for the operation of receiver unit 26. Power source 36 may be a battery of either a disposable or rechargeable type. Alternatively, power source 36 may be a DC power supply of the type well known in the electrical art for supplying DC power when connected to a conventional AC electrical outlet. In a preferred embodiment, power supply 36 utilizes AC electrical power (via the DC power supply) for normal operation but also contains a battery powered "back-up" circuit which will allow the receiver to continue operation even if AC power is lost. A power switch 41 is connected in series with power source 36. Power switch 41 is not required but is preferred. When power switch 41 is not activated, power cannot flow from power source 36 to the rest of the circuit in FIG. 2 such that receiver unit 26 may be turned off to conserve power when it is not being used. Receiving circuit 30 supplies a first output to alarm circuit 32 when non-audible signal 24 is received from transmitter unit 22 and supplies a second output when the non-audible signal is not received. Alarm circuit 32 may be a switch-type circuit which powers sound generator 34 to produce an audible alarm when the first output is received indicating the firearm is being handled but which does not power sound generator 34 when the second output is received indicating the firearm is not being handled. Such a switch-type circuit may comprise a transistor, or relay of types well known in the electrical art for selectively powering a circuit in response to an input having one of two states. With an alarm circuit 32 of this type, receiver unit 26 will produce audible alarm 28 whenever non-audible signal 24 is received from transmitter unit 22 and the audible alarm will stop whenever the non-audible signal is not received from transmitter unit 22. Alternatively, alarm circuit 32 may comprise a latch subcircuit 38 and a reset subcircuit 40 which act as follows: whenever alarm circuit 32 receives an output from receiving circuit 30 indicating that the non-audible signal 24 has been received from transmitter unit 22, alarm circuit 32 will power sound generator 34 to produce audible alarm signal 28 and, at the same time, energize latch subcircuit 38. Once energized, latch subcircuit 38 will cause alarm circuit 32 to continue powering sound generator 34, even if the outputs from receiving circuit 30 indicate that non-audible signal 24 is no longer being received from transmitter unit 22, until latch subcircuit 38 receives a reset signal from reset subcircuit 40. With an alarm circuit 32 of this type, receiver unit 26 will sound audible alarm 28 whenever it receives non-audible signal 24 indicating that the firearm has been handled, and the audible alarm signal will continue even if the protected firearm is returned to its original position, moved beyond the range of the transmitting circuit, or if the transmitting circuit power subsequently fails. Reset subcircuit 40 may produce a reset signal in response to a manual input by the user, in which case reset subcircuit 40 may comprise a manual switch as shown in FIG. 2. Alternatively, reset subcircuit 40 may be a circuit which produces a reset signal at a predetermined time interval after the outputs received from receiving circuit 30 indicate that non-audible signal 24 is no longer being received from transmitter unit 22.

Since receiver unit 26 need not be sized to be inserted into or connected to a firearm, its components, including power source 36 and sound generator 34, may be sized as necessary to produce an audible alarm signal of any desired strength or duration. Using a very loud alarm increases the chance that a young child or other unauthorized person who handles the protected firearm will be frightened to cease and also increase the likelihood that the alarm signal will alert a responsible party who can investigate the situation.

Referring now to FIG. 1, transmitter unit 22 further comprises a housing (not shown), a position-responsive switch 44, a control circuit 46, a transmitting circuit 48, and a power source 50. As will be described in greater detail below, the housing of transmitter unit 22 may be adapted to be received into a chamber of the firearm to be protected or to be attached to the exterior of the firearm to be protected. Position-responsive switch 44 is enclosed within the housing and produces a first output when in a first position and a second output in a second position. Control circuit 46 is enclosed within the housing and is connected to position-responsive switch 44 and to transmitting circuit 48. Transmitting circuit 48 is enclosed in the housing and is connected to control circuit 46 for producing non-audible signal 24 when the protected firearm is moved from a first position to a second position. Power source 50 is enclosed in the housing to supply electrical power to position-responsive switch 44, control circuit 46 and transmitting circuit 48. Power source 50 may be a battery of either the disposable or the rechargeable type. It is preferred that the housing of transmitter unit 22 incorporate a structure which allows the user to access power source 50 for replacement or recharging. A power switch 60 is connected in series with power source 50, and when activated, power switch 60 allows power to flow from power source 50 to the rest of the circuit shown in FIG. 1. While not required, power switch 60 is preferred such that the circuit in FIG. 1 may be turned off when not in use so as to conserve power. Position-responsive switch 44 is a switch of the type having a first output when in a first position and a second output when in a second position. The position-responsive switch may be a mercury switch, a ball-bearing switch, or other types of position-responsive switches known in the art. When transmitter unit 22 has been energized by activating power switch 60, moving the subject firearm will cause position-responsive switch 44 to change states, thus changing the output from position-responsive switch 44 to control circuit 46. When the outputs received by control circuit 46 indicate that the firearm has been handled, control circuit 46 will power transmitting circuit 48, causing transmitting circuit 48 to produce non-audible signal 24. Transmitting circuit 48 may be an FM radio transmitter producing a non-audible signal 24 in the form of an FM radio signal in the frequency range of about 88 MHZ to about 108 MHZ. An antenna 49 may be connected to the transmitting circuit 48 so as to better broadcast non-audible signal 24. Where transmitting circuit 48 is an FM radio transmitter, then receiving circuit 30 of receiver unit 26 must be an FM radio receiver having a compatible frequency range. As previously described, an antenna 31 may be provided on receiver unit 26 to improve the reception of non-audible signals 24. In a preferred embodiment of a firearm safety apparatus utilizing FM radio signals for the non-audible signal, transmitter unit 22 further comprises a first tuning screw (not shown) positioned on transmitter unit 22 for selecting the frequency of non-audible signals 24 produced by transmitting circuit 48 and receiver unit 26 further comprises a second tuning screw (not shown) connected to receiver unit 26 for adapting receiving circuit 30 to receive non-audible signal 24 of transmitter unit 22. Tuning screws on transmitter unit 22 and receiver unit 26 will allow the user to select a clear frequency for non-audible signal 24 and avoid interference by local radio broadcasts.

In another embodiment of the current invention, transmitting circuit 48 may be an ultrasonic acoustic transmitter producing non-audible signal 24 which is an ultrasonic acoustic signal in the range of about 20 kHz to about 62 kHz. In such a case, receiving circuit 30 of receiver unit 26 would be an ultrasonic acoustic receiver adapted to receive non-audible signals of the frequency produced by transmitting circuit 48.

Transmitter unit 22 may also include a sound generator 58 attached to housing 42 and connected to control circuit 46 for producing an audible alarm signal 59 from transmitter unit 22 whenever non-audible signal 24 is produced. While sound generator 58 is not required, its use provides a redundant means for signaling the unauthorized use of the firearm.

Referring now to FIGS. 3–6, various physical configuration of the housing of transmitter unit 22 are described. The housing may be sized to fit into the chamber of a pistol, rifle or shotgun as shown in FIGS. 3 and 4. While the embodiment shown in FIGS. 3 and 4 has a housing 42 for transmitter unit 22 adapted to fit into a chamber 51 of a shotgun, it will be readily apparent to those skilled in the art that housing 42 can be made in the shape and size corresponding to the ammunition for any type of firearm available. When transmitter unit 22 of this embodiment is loaded into the chamber of a firearm, it provides an extra safety factor in that a live round is not in the chamber. This is especially useful in semiautomatic weapons where action of the round exploding is used to cock the weapon and reload for the next round. If the audible alarm signal produced by the alarm device does not frighten the person who is handling the firearm without authorization, such as a child, such semi-automatic firearms will not operate even if the trigger is pulled because the firing pin will fall onto the transmitter unit rather on a live round.

Figure 6:
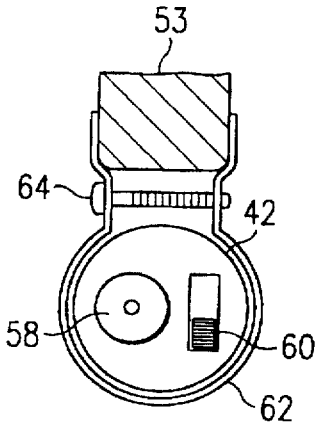
FIG. 6 is a front elevation view of the transmitter unit of FIG. 5 viewed along lines 6—6 of FIG. 5.
Figure 5:
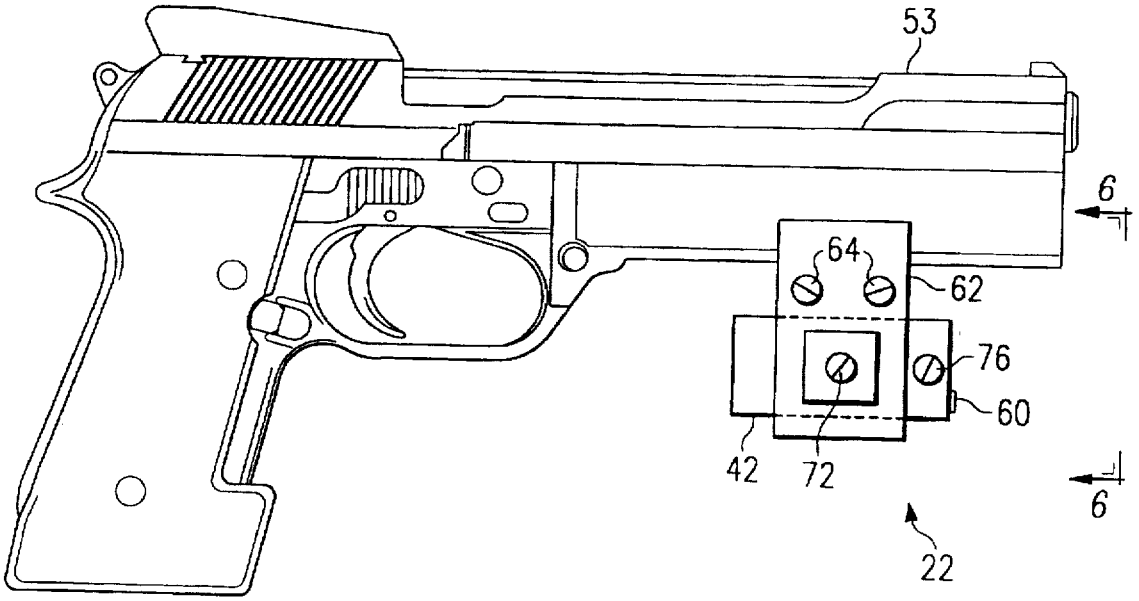
FIG. 5 is a side elevation view of a transmitter unit according to another embodiment of the current invention attached to the exterior of a firearm.

Alternatively, as shown in FIGS. 5 and 6, housing 42 of transmitter unit 22 may be adapted for attachment to the exterior of a firearm 53. In the embodiment shown in FIGS. 5 and 6, a clamp 62 and screws 64 are used to attach transmitter unit 22 beneath the muzzle of firearm 53, however, those skilled in the art will appreciate that the exact hardware used to mount transmitter unit 22 onto firearm 53 and the exact location at which transmitter unit 22 is mounted to firearm 53 may be varied while keeping within the scope of the present invention.

Referring again to FIGS. 3 and 4, an embodiment of the current invention is shown in which housing 42 of transmitter unit 22 is adapted to be received into the chamber 51 of a firearm. In FIG. 3, a portion of the transmitter unit designed 22*a* (shown in phantom) is shown in position before it is inserted into chamber 51. Located within housing 42 is power switch 60. Connected to power switch 60 and extending from housing 42 is a contact member 61. As transmitter unit 22 is moved in the direction of arrow 66 from a first position outside the chamber, shown at 22*a*, into a second position inside the chamber, shown at 22*b*, contact member 61 will be moved from a first position shown as 61*a* to a second position shown as 61*b* whereby power switch 60 will be activated, energizing transmitter 22 for operation. Although the embodiment in FIG. 3 shows a power switch 60 and contact member 61 having the configuration of a lever activated microswitch, those skilled in the art will appreciate that other configurations of power switch and contact member are within the scope of the invention.

Also shown in FIG. 3 is position-responsive switch 44 located within housing 42 of transmitter unit 22. Position-responsive switch 44 may be a mercury switch, a ball bearing switch, or other types of position-responsive switches known in the art. Position-responsive switch 44 is preferably mounted to housing 42 by a set screw 72 which allows the user to vary the orientation of position-responsive switch 44 within housing 42 in the direction of arrow 74. By varying the orientation of position-responsive switch 44 within housing 42 and varying the orientation of transmitter unit 22 within firearm chamber 51, the user can obtain a satisfactory orientation of position-responsive switch 44 regardless of the storage position of the firearm.

Also shown in FIG. 3 is the location of transmitting circuit 48 within housing 42. Where transmitter 48 is an FM radio transmitter, a tuning screw 76 may be provided extending through housing 42 and connected to transmitting circuit 48 whereby the user may select the frequency of the non-audible signal produced by transmitter unit 22 to avoid interference caused by local radio broadcasts. Also shown in FIGS. 3 and 4 are the general locations of control circuit 46, power source 50, sound generator 58 and antenna 49 within housing 42 of transmitter unit 22. Those skilled in the art will readily appreciate that the configuration of these components and their locations within housing 42 of transmitter unit 22 may be varied considerably while remaining within the scope of the current invention.

Referring now to FIGS. 5 and 6, an alternative embodiment of the current invention is shown in which transmitter unit 22 is adapted for connection to the exterior of a firearm 53 such that normal handling and operation of the firearm are not affected. In the embodiment shown in FIGS. 5 and 6, a clamp 62 and screws 64 are used to attach housing 42 of transmitter unit 22 to firearm 53. In this embodiment, power switch 60 is a manual switch located on the forward end of transmitter unit 22. Also shown in FIG. 5 is set screw 72 allowing the user to adjust the orientation of position-responsive switch (not shown) and tuning screw 76 allowing the user to adjust the frequency of the non-audible signal produced by transmitter unit 22 when the firearm is handled. Referring to FIG. 6, the position of power switch 60 on the front of transmitter unit 22 is shown, as is the location for optional sound generator 58. As those skilled in the art will readily appreciate, the configuration and arrangement of the components on transmitter unit 22 could be varied from that shown in FIGS. 5 and 6 without departing from the scope of the current invention. Similarly, the attachment structures used to connect the transmitter unit 22 to the exterior of the firearm 53 could be varied widely without departing from the scope of the invention.

Figure 7:
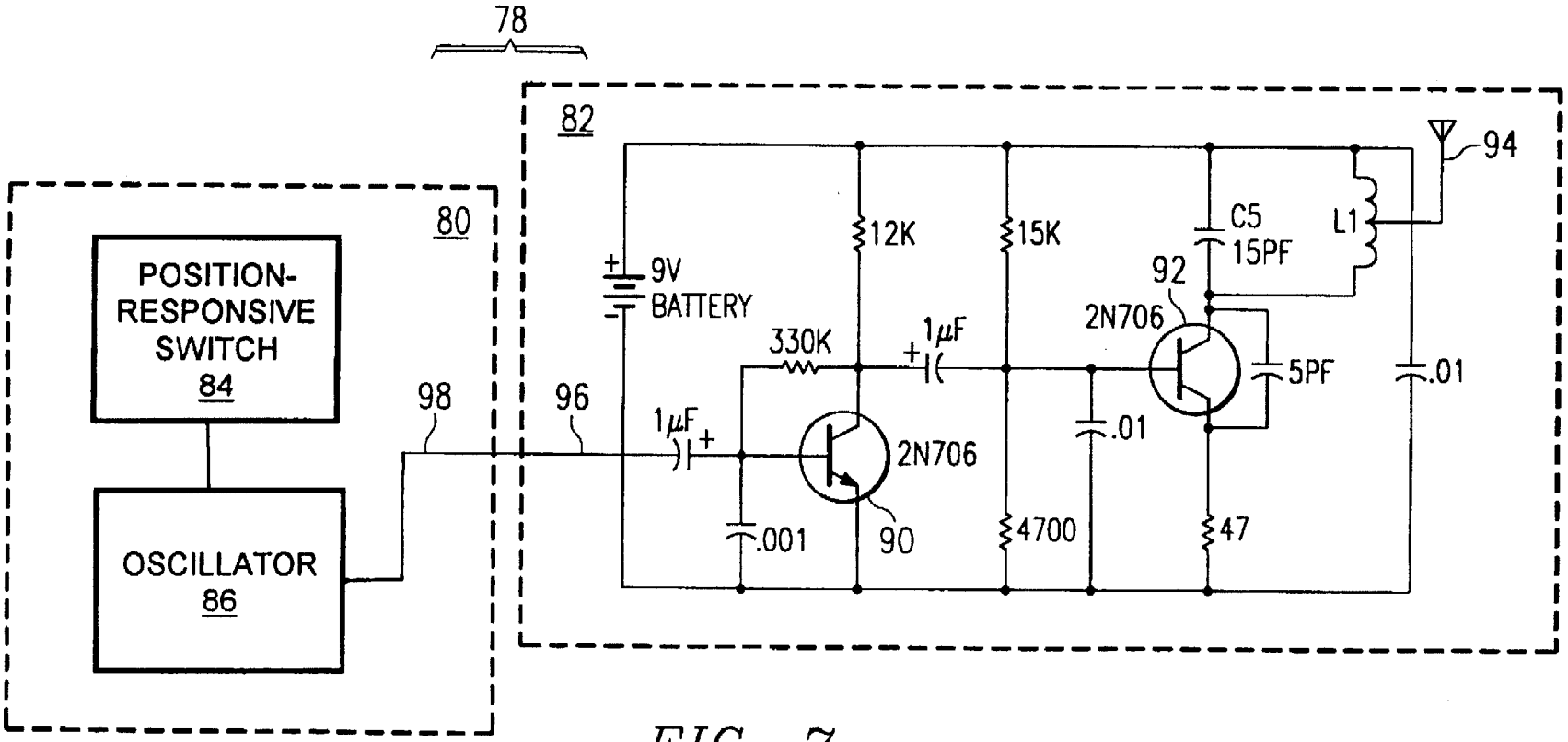
FIG. 7 is a schematic circuit diagram of a preferred embodiment of a transmitter unit according to the current invention.
Figure 8:
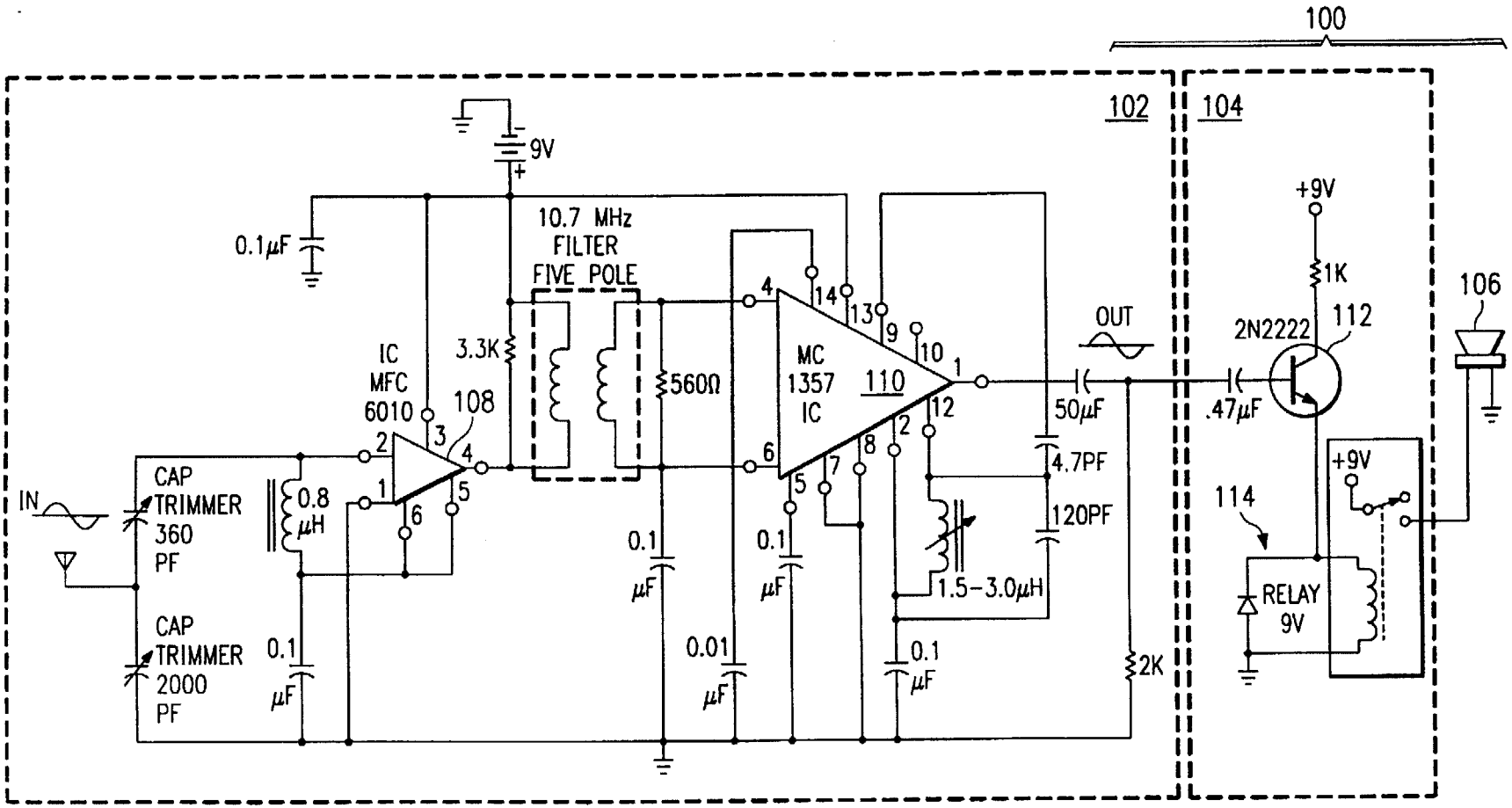
FIG. 8 is a schematic circuit diagram of a preferred embodiment of a receiver unit according to the current invention.

Referring now to FIGS. 7 and 8, one example of circuitry which could be used to implement the current invention is shown. The transmitting and receiving circuits shown were derived from circuits illustrated in *Encyclopedia of Electronic Circuits*, Rudolf E. Graf, Vol. 1, pp. 545, 681 (1985), however, those skilled in the art will appreciate that circuits for implementing this invention may have a range of configurations.

Referring now to FIG. 7, the circuitry for a transmitter unit 78 is shown comprising two modules, a sensor/control module 80 and a transmitter module 82. Sensor/control module 80 comprises a position-responsive circuit 84, an oscillator 86 and additional electronic components, such as a power source (not shown) which accomplish the functions of control circuit 46 and position-responsive switch 44 shown in the block diagram of FIG. 1. Position-responsive circuit 84 is connected to oscillator 86 which, in turn, is connected to transmitter module 82 by sensor/control output 98 and transmitter module input 96. Handling the firearm protected by the transmitter will activate position-responsive circuit 84 to cause oscillator 86 to produce a control signal at output 98. The selection and arrangement of components in sensor/control module 80 may be varied to use other components or configurations as is well known in the electronic art while remaining within the scope of the current invention.

Transmitter module 82 comprises an FM radio circuit including two transistors 90, 92 and a variety of additional electronic components connected as shown in FIG. 7 to produce an FM signal from antenna 94 upon the receipt of a control signal at transmitter module input 96 from output 98 of sensor/control module 80 indicating that the firearm has been handled. The embodiment shown in FIG. 7 does not include the optional power switch or sound generator shown in the block diagram of FIG. 1. The power source for the circuit shown in FIG. 7 may be a 9-volt battery connected as shown.

Referring now to FIG. 8, a circuit for receiver unit 100 is shown comprising a receiver module 102, an alarm module 104 and a sound generator 106. The receiver module 102 shown in FIG. 8 is an FM receiver of the type well known in the electrical art. Receiver module 102 comprises two integrated circuits 108 and 110 and additional electrical components connected as shown in FIG. 8. Integrated circuit 108 is preferably a MFC6010, and integrated circuit 110 is preferably a MC1357, and the values for other components are shown in FIG. 8. Those skilled in the art will appreciate that many other configurations for FM receivers could be used without departing from the scope of the current invention. Alarm module 104 comprises a transistor 112, a relay 114 and various additional electrical components as shown in FIG. 8. Transistor 112 is preferably a 2N2222 transistor and relay 114 is preferably a nine volt relay, however, those skilled in the art will readily appreciate that many of these components could be varied without departing from the scope of the current invention. Sound generator 106 may be an electrical horn, piezo buzzer, or other form of sound generator. The power source for the receiver unit shown in FIG. 8 may be a 9-volt battery.

It will be obvious to those skilled in the art that many alterations and modifications may be made to the described circuitry and components without departing from the invention. Accordingly, it is intended that all such alterations and modifications be considered within the spirit and scope of the invention as defined by the appended claims.

I claim:

1. A firearm safety apparatus, comprising:

(a) a transmitter unit adapted for connection to a firearm for producing a non-audible signal when the firearm is handled;

(b) a receiving circuit for receiving said non-audible signals from said transmitter unit, said receiving circuit having a first output when said non-audible signal is received from said transmitter and having a second output when said non-audible signal is not received from said transmitter;

(c) an alarm circuit connected to said receiving circuit for receiving said outputs from said receiving circuit and powering a sound generator having:

(i) a latch sub-circuit for powering said sound generator to produce said audible alarm signal when said non-audible signal from said transmitter unit is received by said receiving circuit and, after said receiving circuit has received said non-audible signal, for continuing to power said sound generator when said non-audible signal is not received by said receiving circuit until a reset signal is received by said latch sub-circuit; and (ii) a reset sub-circuit connected to said latch sub-circuit for producing a reset signal;

(d) a sound generator connected to said alarm circuit for producing said audible alarm signal when the firearm is handled; and (e) a power source to supply electrical power to said receiving circuit, alarm circuit, and sound generator.

2. A firearm safety apparatus according to claim 1, wherein said reset sub-circuit produces a reset signal in response to a manual input by the user.

3. A firearm safety apparatus according to claim 1, wherein said reset sub-circuit automatically produces a reset signal a predetermined time interval after said receiving circuit stops receiving said non-audible signal from said transmitter unit after having first received said non-audible signal.

4. A firearm safety apparatus, comprising:

(a) a transmitter unit adapted for connection to a firearm for producing a non-audible signal when the firearm is handled having:

(i) a housing adapted for connection to a firearm;

(ii) a position-responsive switch enclosed within said housing, said position-responsive switch having a first output when in a first position, and a second output when in a second position;

(iii) a control circuit enclosed within said housing and connected to said position-responsive switch for powering a transmitting circuit;

(iv) a transmitting circuit enclosed in said housing and connected to said control circuit for producing said non-audible signal in the form of a radio transmission when the firearm is moved from a first position to a second position; and (v) a power source enclosed in said housing to supply electrical power to said position-responsive switch, control circuit, and transmitting circuit;

(b) a receiving circuit for receiving said non-audible signals from said transmitter unit, said receiving circuit having a first output when said non-audible signal is received from said transmitter and having a second output when said non-audible signal is not received from said transmitter;

(c) an alarm circuit connected to said receiving circuit for receiving said outputs from said receiving circuit and powering a sound generator;

(d) a sound generator connected to said alarm circuit for producing said audible alarm signal when the firearm is handled; and (e) a power source to supply electrical power to said receiving circuit, alarm circuit, and sound generator.

5. A firearm safety apparatus according to claim 4, further comprising:

a first tuning screw extending through said housing on said transmitter unit and connected to said transmitting circuit for selecting the frequency of said non-audible signal produced by said transmitting circuit; and a second tuning screw positioned on said receiver unit and connected to said receiving circuit for adapting said receiving circuit to receive the non-audible signal of the transmitter unit.

6. The apparatus of claim 4 wherein said radio transmission is an FM radio signal in the frequency range of about 88 MHZ to about 108 MHZ.

7. The firearm safety apparatus of claim 4 wherein said radio transmission is an AM radio signal.

8. A firearm safety apparatus, comprising:

(a) a transmitter unit adapted for connection to a firearm for producing a non-audible signal when the firearm is handled having:

(i) a housing adapted for connection to a firearm;

(ii) a position-responsive switch enclosed within said housing, said position-responsive switch having a first output when in a first position, and a second output when in a second position;

(iii) a control circuit enclosed within said housing and connected to said position-responsive switch for powering a transmitting circuit;

(iv) a transmitting circuit enclosed in said housing and connected to said control circuit for producing said non-audible signal in the form of an ultrasonic acoustic signal when the firearm is moved from a first position to a second position; and (v) a power source enclosed in said housing to supply electrical power to said position-responsive switch, control circuit, and transmitting circuit;

(b) a receiving circuit for receiving said non-audible signals from said transmitter unit, said receiving circuit having a first output when said non-audible signal is received from said transmitter and having a second output when said non-audible signal is not received from said transmitter;

(c) an alarm circuit connected to said receiving circuit for receiving said outputs from said receiving circuit and powering a sound generator;

(d) a sound generator connected to said alarm circuit for producing said audible alarm signal when the firearm is handled; and (e) a power source to supply electrical power to said receiving circuit, alarm circuit, and sound generator.

* * * * *